US006250282B1

(12) United States Patent
Osaki et al.

(10) Patent No.: US 6,250,282 B1
(45) Date of Patent: Jun. 26, 2001

(54) IDLE ROTATION SPEED LEARNING CONTROL METHOD AND APPARATUS OF AN ELECTRONICALLY CONTROLLED THROTTLE TYPE INTERNAL COMBUSTION ENGINE

(75) Inventors: Hiroyuki Osaki; Hajime Hosoya, both of Atsugi; Hiroshi Katoh, Yokohama; Shigeaki Kakizaki, Yokohama; Mikio Matsumoto, Yokohama, all of (JP)

(73) Assignees: Unisia Jecs Corporation; Nissan Motor Co., Ltd., both of Kanagawa-Ken (JP)

( * ) Notice: Subject to any disclaimer, the term of this patent is extended or adjusted under 35 U.S.C. 154(b) by 0 days.

(21) Appl. No.: 09/384,402

(22) Filed: Aug. 27, 1999

(30) Foreign Application Priority Data

Aug. 28, 1998 (JP) ..... 10-244111

(51) Int. Cl.[7] ..... F02D 41/16; F02D 41/14

(52) U.S. Cl. ..... 123/339.14; 123/339.19; 123/339.21; 123/352

(58) Field of Search ..... 123/339.14, 339.15, 123/339.21, 361, 399, 350, 352, 339.19, 339.23

(56) References Cited

U.S. PATENT DOCUMENTS 4,545,349 * 10/1985 Ito et al. ..... 123/339.11
4,836,166 * 6/1989 Wietelmann ..... 123/358
5,002,026 * 3/1991 Ohkumo et al. ..... 123/339.22
5,590,630 * 1/1997 Kurihara et al. ..... 123/339.21
5,720,258 * 2/1998 Tolkacz et al. ..... 123/352

FOREIGN PATENT DOCUMENTS

09068085 * 3/1997 (JP) .

* cited by examiner

*Primary Examiner*—Henry C. Yuen
*Assistant Examiner*—Hieu T. Vo
(74) *Attorney, Agent, or Firm*—McDermott, Will & Emery

(57) ABSTRACT

With an electronically controlled throttle type internal combustion engine, where a target opening of a throttle valve is set according to a required output of the engine, and the throttle valve is opened and closed with an actuator so as to obtain a target opening; air quantity learning for learning and correcting the target opening of the throttle valve so as to obtain a target intake air quantity is performed by comparing an intake air quantity estimated based on a detection value of the throttle valve opening and an actually detected intake air quantity, at the time of idling the engine. After completion of the air quantity learning, friction learning for learning and correcting the target opening of the throttle valve so as to obtain a target engine output is performed while feedback controlling the throttle valve opening so that the engine rotation speed approaches a target idle rotation speed, at the time of idling the engine. In this way, it is possible to effect control which makes the throttle valve opening correspond very accurately to the required engine output, over a long period of time.

12 Claims, 6 Drawing Sheets

IDLE ROTATION SPEED LEARNING CONTROL METHOD AND APPARATUS OF AN ELECTRONICALLY CONTROLLED THROTTLE TYPE INTERNAL COMBUSTION ENGINE

BACKGROUND OF THE INVENTION

1. Field of the Invention

The present invention relates to an idle rotation speed learning control method and apparatus of an electronically controlled throttle type internal combustion engine. More particularly, the present invention relates to a method and apparatus for learning and correcting a target opening of a throttle valve at the time of idling, in an internal combustion engine having an electronically controlled throttle system for electronically controlling the opening of the throttle valve.

2. Description of the Related Art

Heretofore, there is known an electronically controlled throttle system where the throttle valve is opened and closed by an actuator such as a motor or the like, and a target air quantity is set based on an accelerator operation amount, and the opening of the throttle valve is electronically controlled to an opening giving the target air quantity.

Moreover, there is known a construction where, at the time of idling the engine, while feedback controlling the intake air quantity of the engine so that the engine rotation speed approaches a target idle rotation speed, when predetermined learning conditions materialized, the air quantity due to the feedback correction is learned as a fluctuation amount of a required intake air quantity due to friction of the engine or variations in the combustion efficiency, and a change amount in an opening area with lapse of time due to soiling or blocking of an intake system or deterioration or replacement of other parts, or the like. The intake air quantity and the target opening of the throttle valve are then corrected based on the learned values.

With the system as described above however, which collectively learns the fluctuation amount of the required intake air quantity and the change amount in the opening area only by the feedback control of the engine rotation speed at the idling time, the learning accuracy cannot be increased sufficiently. That is to say, with the above method, a discrepancy between a detection value of the throttle valve opening and the actual opening cannot be learned, and only the discrepancy of the detection value of the throttle valve opening with respect to the fluctuation amount of the required intake air quantity and the change amount in the opening area can be learned. Hence, the target opening of the throttle valve cannot be corrected sufficiently accurately in response to a required engine output.

The present invention addresses the above problems with the object of effecting control in an internal combustion engine comprising an electronically controlled throttle system, which makes the opening of the throttle valve correspond very accurately to the required engine output.

Moreover, it is another object of the present invention to effect control which makes the opening of the throttle valve correspond very accurately to the required engine output over a long period of time.

It is a further object of the present invention to be able to avoid the influence of programming bugs.

SUMMARY OF THE INVENTION

Therefore, an idle rotation speed learning control method of an electronically controlled throttle type internal combustion engine according to the present invention comprises the steps of:

setting a target opening of a throttle valve according to a required output of an engine, and opening and closing the throttle valve with an actuator so as to obtain the target opening;

performing air quantity learning for learning and correcting the target opening of the throttle valve so as to obtain a target intake air quantity, by estimating an intake air quantity based on a detection value of the throttle valve opening and comparing the estimated intake air quantity and an actually detected intake air quantity, at the time of idling the engine; and after completion of the air quantity learning, performing friction learning for learning and correcting the target opening of the throttle valve so as to obtain a target engine output, while feedback controlling the throttle valve opening so that the engine rotation speed approaches a target idle rotation speed, at the time of idling the engine.

Furthermore, an idle rotation speed learning control apparatus of an electronically controlled throttle type internal combustion engine according to the present invention comprises:

a target opening setting device for setting a target opening of a throttle valve according to a required output of an engine;

a throttle valve drive device for opening and closing the throttle valve with an actuator so as to obtain the target opening;

an air quantity learning device for learning and correcting the target opening of the throttle valve so as to obtain a target intake air quantity, by comparing an intake air quantity estimated based on a detection value of the throttle valve opening and an actually detected intake air quantity, at the time of idling the engine;

a friction learning device for learning and correcting the target opening of the throttle valve so as to obtain a target engine output, while feedback controlling the throttle valve opening so that the engine rotation speed approaches a target idle rotation speed, at the time of idling the engine; and a learning sequence device for performing learning by means of the friction learning device, after learning by means of the air quantity learning device is completed.

According to the method and apparatus of the present invention, after the target opening of the throttle valve is learned and corrected so as to obtain the target intake air quantity, the target opening of the throttle valve is learned and corrected so as to obtain the target engine output.

Therefore, after the target opening is learned and corrected with respect to a change amount in the opening area with the lapse of time due to soiling or blocking of the throttle valve, for the deviation between the detection value of the throttle valve opening and the actual opening, the target opening is learned and corrected with respect to variations of friction or combustion efficiency. Hence, it is possible to effect control which makes the throttle valve opening correspond very accurately to the required engine output, over a long period of time.

Moreover, the air quantity learning may involve calculating a correction amount for a detection value of the throttle valve opening so that the intake air quantity estimated based on the detection value of the throttle valve opening and a detection value of the engine rotation speed becomes equal to the actually detected intake air quantity, and correcting the target opening of the throttle valve based on the correction amount.

In this way, the correction amount for the detection value of the throttle valve opening is calculated so that the intake air quantity estimated based on the detection value of the throttle valve opening and the detection value of the engine rotation speed becomes equal to the actual intake air quantity detected by an airflow meter or the like. By correcting the target opening of the throttle valve according to the correction amount, a target intake air quantity corresponding to the target opening can be obtained.

Furthermore, the correction amount calculated by the air quantity learning may be limited by a limit value.

In this way, the possibility of the correction amount calculated by the air quantity learning becoming an excessive value due to some cause such as a programming bug, is prevented by limiting with the limit value.

Furthermore, the air quantity learning may judge the time when more than a predetermined number of learning are performed as completion of the air quantity learning.

In this way, the friction learning can be started, after the air quantity learning is sufficiently performed to obtain a high accurate learning value of the air quantity.

Moreover, the friction learning may involve calculating the friction learning value based on an average value obtained by sampling the feedback correction quantity of the intake air quantity for a plurality of times for every predetermined sampling period.

In this way, a high accurate friction learning can be performed while avoiding influences such as noise.

Moreover, for the learning value calculation based on the average value, for example, the learning value is updated by average weighting the previous learning value and the average value of the intake air quantity.

DESCRIPTION OF THE PREFERRED EMBODIMENT

Figure 1:
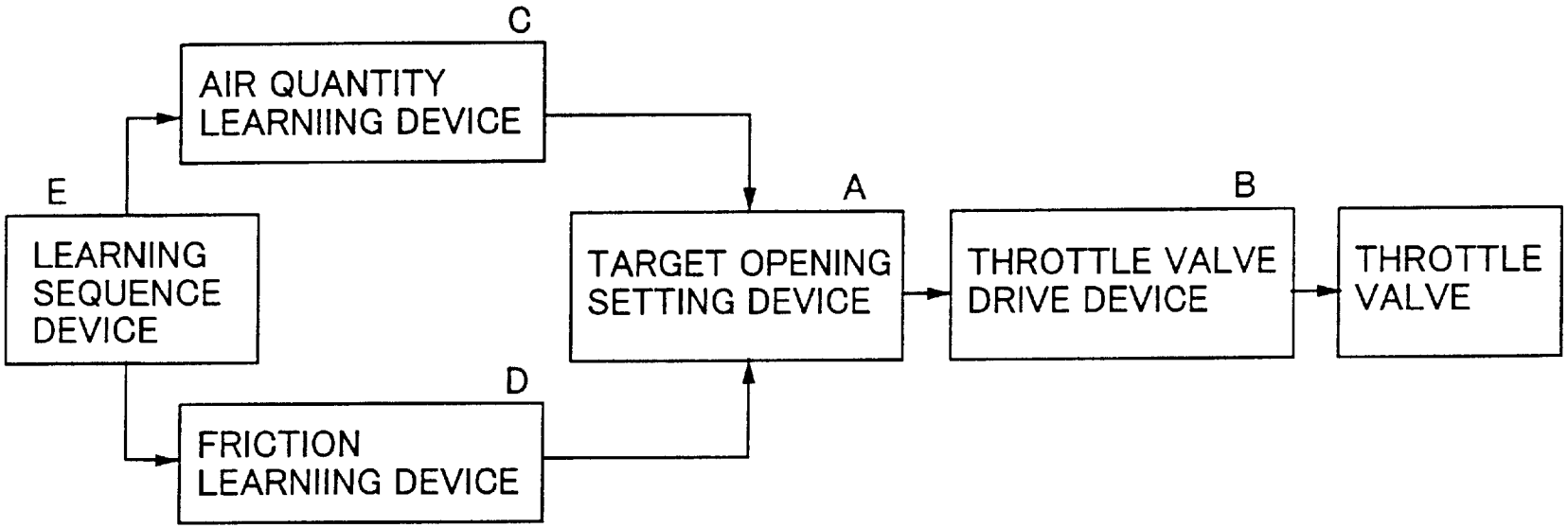
FIG. 1 is a block diagram showing a basic construction of an apparatus according to the present invention.

An apparatus according to the present invention comprises various devices, as shown in FIG. 1.

A target opening setting device A sets a target opening of a throttle valve according to a required output of an engine.

A throttle valve drive device B opens and closes the throttle valve with an actuator so that as to obtain the target opening.

An air quantity learning device C learns and corrects the target opening of the throttle valve so as to obtain a target intake air quantity, by comparing an intake air quantity estimated based on a detection value of the throttle valve opening and an actually detected intake air quantity, at the time of idling the engine.

A friction learning device D learns and corrects the target opening of the throttle valve so as to obtain a target engine output, while feedback controlling the throttle valve opening so that the engine rotation speed approaches a target idle rotation speed, at the time of idling the engine.

A learning sequence device E performs learning by means of the friction learning device D, after learning by means of the air quantity learning device C is completed.

An embodiment of the present invention will now be described.

Figure 2:
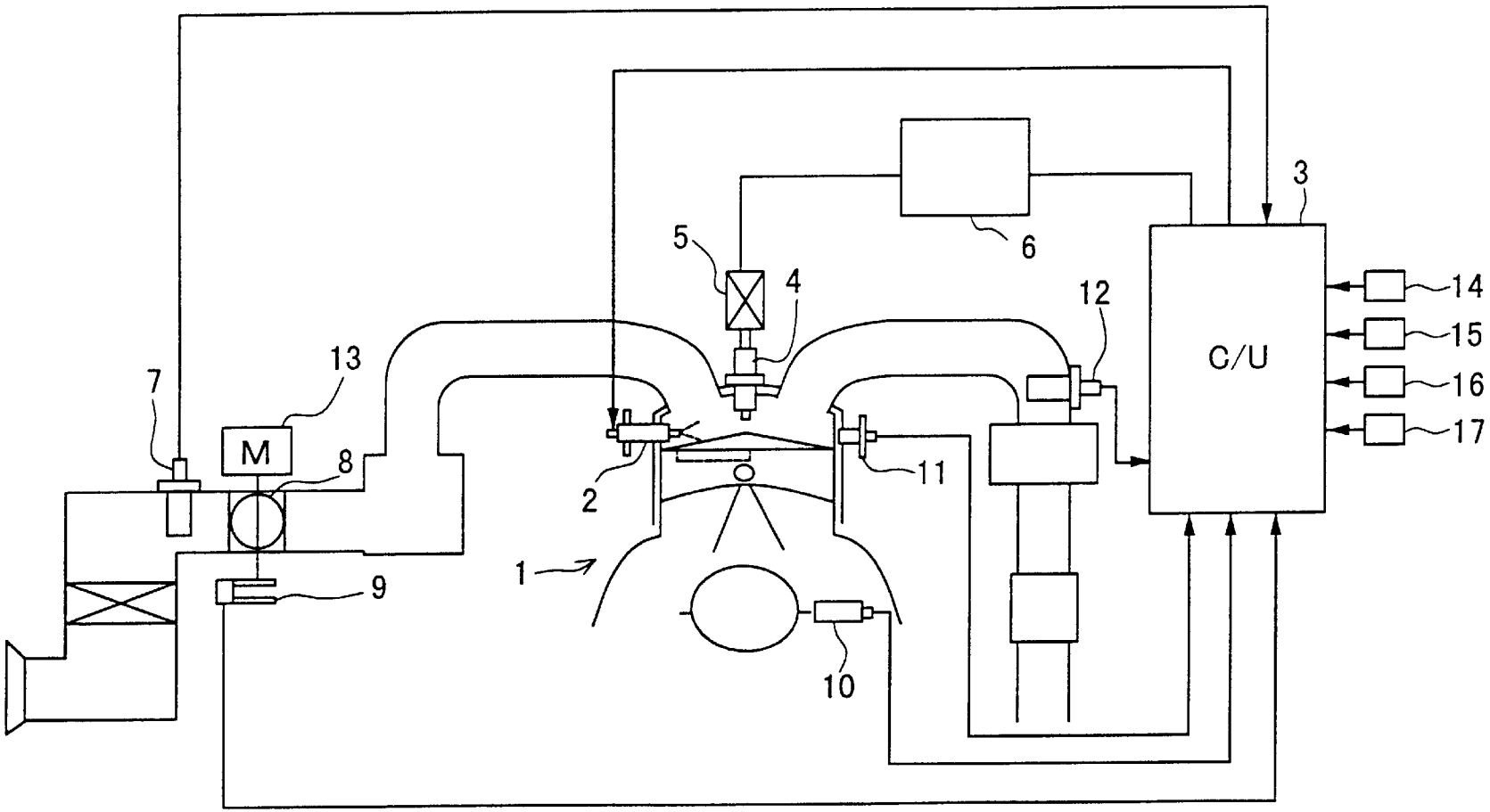
FIG. 2 is a system structural diagram of an internal combustion engine in an embodiment of the present invention.

FIG. 2 is a system structural diagram of an internal combustion engine in this embodiment. The internal combustion engine 1 shown in FIG. 2 is a direct injection type gasoline engine (a direct injection type spark ignition engine) which comprises fuel injection valves 2 for directly injecting fuel into a cylinder for each cylinder, and ignition plugs 4 for each cylinder.

The fuel injection valves 2 are controlled for each cylinder in response to an injection pulse signal from a control unit 3 having a microcomputer built therein. Moreover, each ignition plug 4 is respectively provided with an ignition coil 5, and the ignition timing is controlled for each cylinder by on/off switching of power to a primary side of each ignition coil 5 by means of a power transistor unit 6 in response to an ignition signal from the control unit 3.

Moreover, there is provided an electronically controlled throttle system for opening and closing a throttle valve 8 for metering an intake air quantity to the engine, by means of a motor 13 controlled by the control unit 3.

Detection signals from various sensors are input to the control unit 3 for controlling fuel injection, ignition timing, throttle valve opening and the like.

For the various sensors there is provided, an airflow meter 7 for detecting an intake air quantity, a throttle sensor 9 for detecting an opening of the throttle valve 8, a crank angle sensor 10 for detecting a crank angle, a water temperature sensor 11 for detecting the temperature of cooling water, an oxygen sensor 12 for detecting a mean air-fuel ratio of the combustion mixture based on oxygen concentration in the exhaust gas, a vehicle speed sensor 14 for detecting the vehicle speed, a neutral switch 15 for detecting the neutral condition of a transmission, an electrical load switch 16, an accelerator opening sensor 17 and the like.

Here, the control unit 3 is provided with a plurality of target equivalence ratio maps in which the target equivalence ratio (the target air-fuel ratio) and the combustion mode have been previously set in accordance with target output torque and engine rotation speed. The control unit 3 refers to the plurality of target equivalence ratio maps while changing over in accordance with conditions of the cooling water temperature, time after start-up, vehicle speed, acceleration and the like, and determines requirements for the target equivalence ratio and the combustion mode, to control the fuel injection quantity and injection timing by means of the fuel injection valves 2.

As the combustion mode, two modes are set: a homogeneous charge combustion mode for performing homogeneous combustion by injecting fuel in the intake stroke, and a stratified charge combustion mode for performing stratified lean combustion by injecting fuel in the compression stroke to form a rich mixture in the vicinity of the ignition plug 4. In the homogeneous charge combustion mode, the target equivalence ratio is controlled to be lean, stoichiometric (theoretical air-fuel ratio) and rich according to the operating range. In the stratified charge combustion mode, the target equivalence ratio is controlled to be richer than that at the time of homogeneous lean combustion.

Various controls according to the present invention by means of the control unit 3 will now be described.

Figure 3:
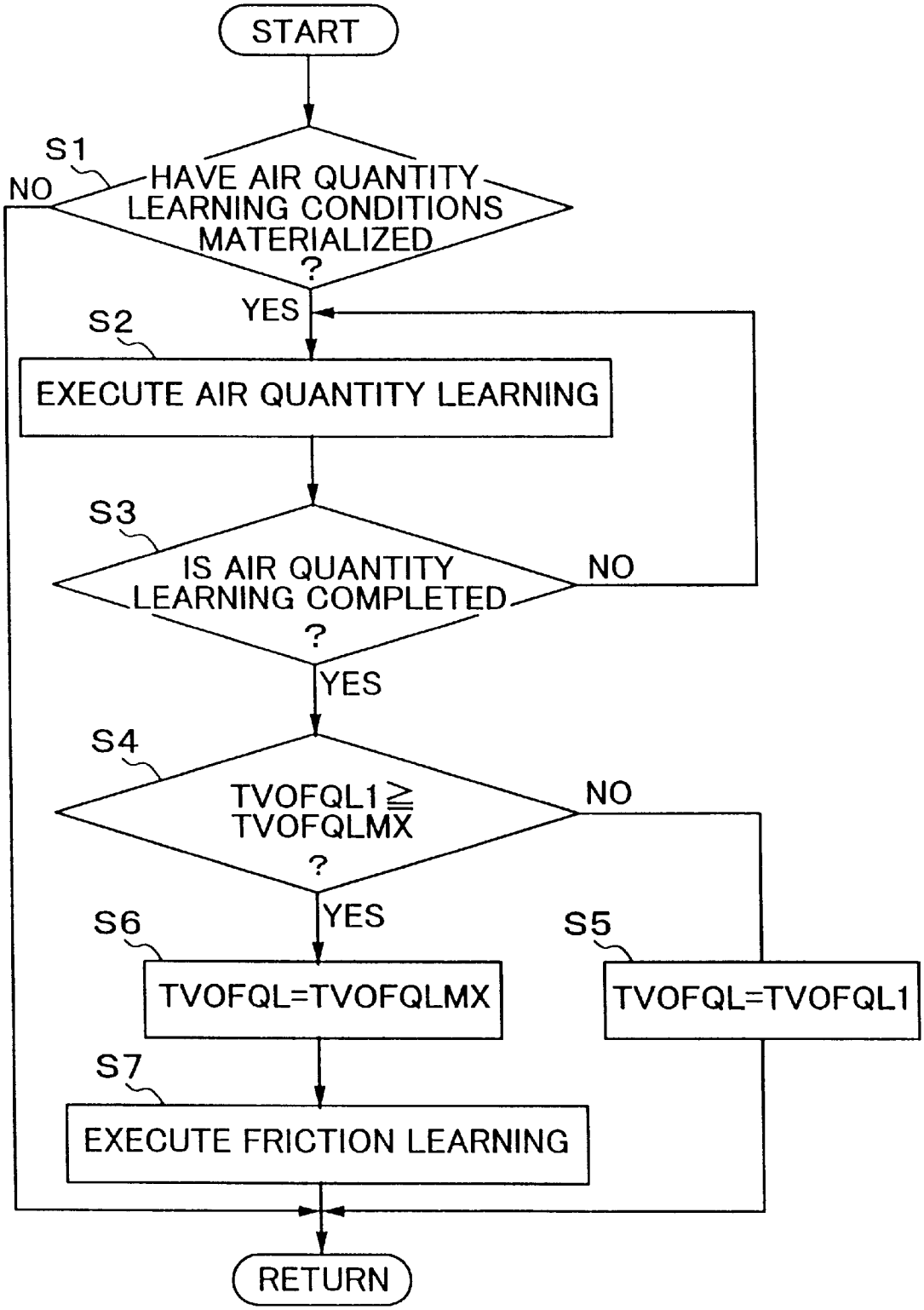
FIG. 3 is a flow chart showing a sequence control routine for air quantity learning and friction learning in the above embodiment.

FIG. 3 is a flow chart showing a sequence control routine for air quantity learning and friction learning.

In step 1, it is judged if learning conditions for air quantity learning have materialized.

When the learning conditions have materialized, then in step 2, air quantity learning is performed. This air quantity learning will be described later.

In step 3, it is judged if air quantity learning has been completed. Specifically, it is judged that learning has been completed when learning has been performed for a predetermined number of times or more.

If judged in step 3 that air quantity learning has been completed, control proceeds to step 4 where it is judged if a finally calculated air quantity learning value TVOFQL1 equals to or exceeds an upper limit value TVOFQLMX.

If TVOFQL1<TVOFQLMX, then in step 5, the air quantity learning value TVOFQL is made TVOFQL1, but if TVOFQL1≧TVOFQLMX, then in step 6, the air quantity learning value TVOFQL is limited to TVOFQLMX.

By limiting the air quantity learning value TVOFQL to the upper limit value TVOFQLMX, the air quantity learning value TVOFQL is prevented from becoming an excessive value due to some cause such as a programming bug.

After air quantity learning is completed, control proceeds to step 7 where friction learning is performed. This friction learning will be described later.

Figure 4:
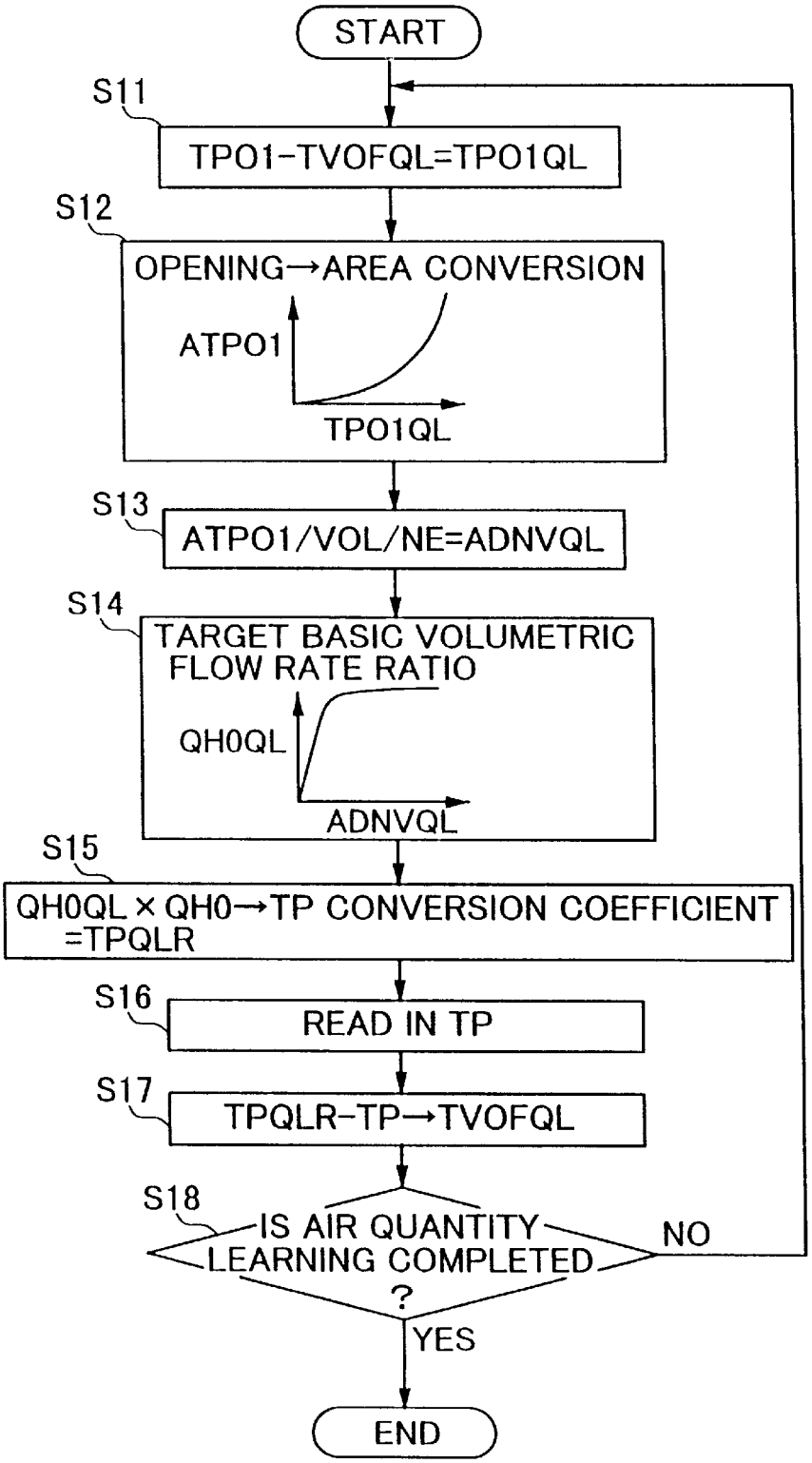
FIG. 4 is a flow chart showing an air quantity learning routine in the above embodiment.

The above described air quantity learning will now be described in accordance with the flow chart in FIG. 4. This air quantity learning is performed so as to learn and correct the target opening of the throttle valve so as to obtain the target intake air quantity, by learning a deviation of a detection value of the throttle valve opening from an actual throttle valve opening.

In step 11, the previous air quantity learning value TVOFQL is subtracted from the throttle valve opening TPQ1 detected by the throttle sensor 9 to calculate a corrected throttle valve opening TPQ1QL.

In step 12, the corrected throttle valve opening TPQ1QL is converted into a corrected throttle opening area ATPO1.

In step 13, the corrected throttle opening area ATPO1 is divided by engine displacement VOL and engine rotation speed NE, to thereby calculate ADNVQL corresponding to the opening area/induction volume.

In step 14, a target basic volumetric flow rate ratio QHOQL is calculated from the ADNVQL. Here, this has the characteristic that when the throttle opening area ATPO1 is small, the flow becomes sonic flow, and the volumetric flow rate increases in proportion to the increase in the opening area, approaching a saturated state with the increase in opening area.

In step 15, the target basic volumetric flow rate ratio QHOQL is multiplied by a volumetric flow rate for a reference condition (standard condition), that is, a mass flow rate conversion coefficient, to thereby convert it into a mass flow rate TPQLR in the reference condition.

In step 16, the mass flow rate TP is read by the airflow meter.

Then in step 17, the mass flow rate TPQLR based on the throttle valve opening calculated in step 15, and the actual mass flow rate TP read in step 16 are compared, to set the air quantity learning value TVOFQL of the throttle valve with respect to the deviation of the mass flow rate TPQLR to the actual mass flow rate TP.

That is to say, if the mass flow rate TPQLR is larger (smaller) than the actual mass flow rate TP, the detection value of the throttle valve opening is larger (smaller) than the actual opening. Therefore, the air quantity learning value TVOFQL is set to a positive (negative) value, to continue with the learning so that control returns to step 11 where the detection value of the throttle valve opening is corrected by the air quantity learning value TVOFQL to make the mass flow rate TPQLR approach the actual mass flow rate TP.

The number of times of learning is counted, and when in step 17 the count value reaches a predetermined value, then in step 18 it is judged that the learning is completed, and learning is terminated.

For the learning value in the air quantity learning performed in a short cycle in this way, in the case where there are changes in the learning value, part of the air quantity executed at such high speed for each OFF of the ignition may be replaced with a low speed learning value coping with parts deterioration. Moreover the construction may be such that when the parts are replaced, the learning value executed at the high speed is more promptly replaced with the low speed learning value. With such a construction, excellent control of the throttle valve opening can be initiated from the initial stage, even if the parts are deteriorated or replaced. Here, even in the case where such low-speed learning is adopted, when the high speed learning is completed, the friction learning is initiated.

Figure 5:
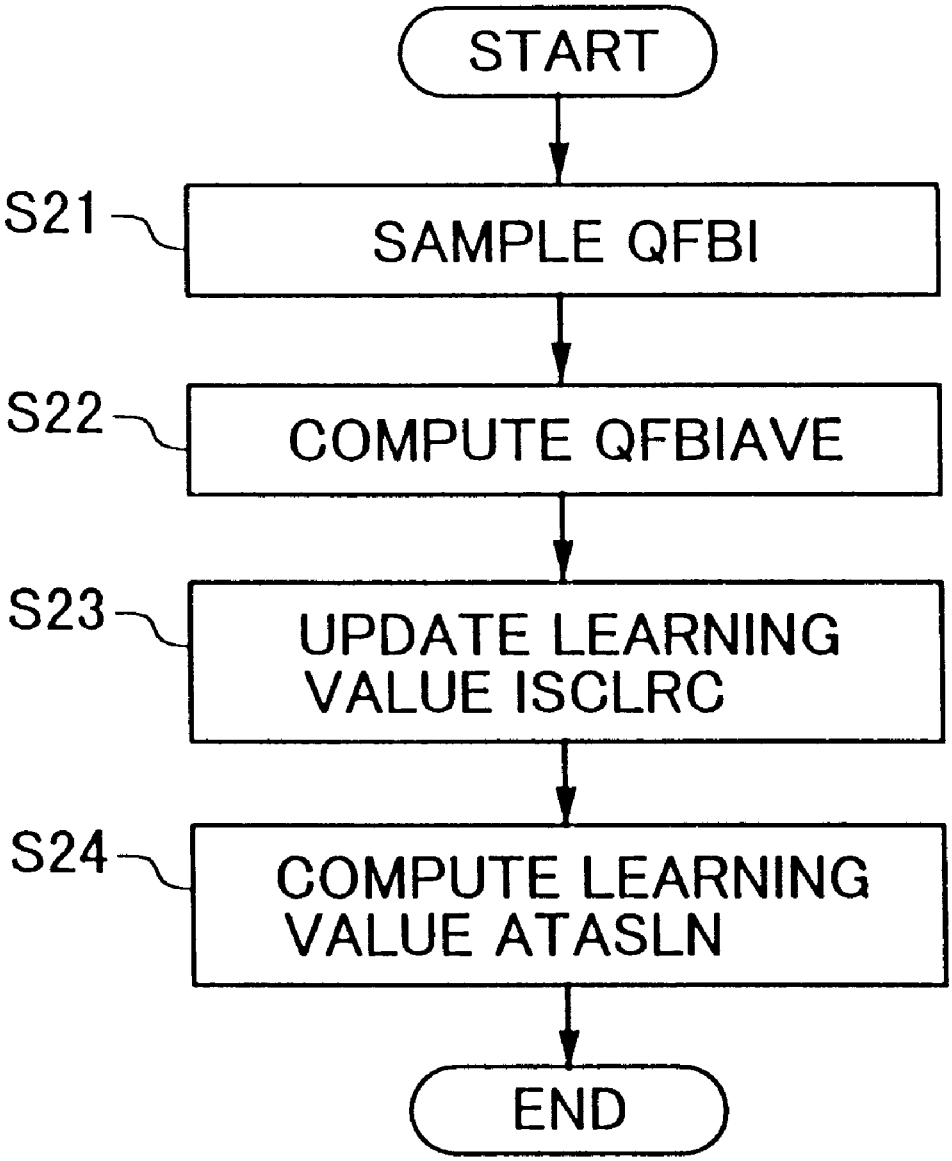
FIG. 5 is a flow chart showing a friction learning routine in the above embodiment.

Next, the friction learning will be described in accordance with the flow chart in FIG. 5.

In step 21, while feedback controlling the idle rotation speed to the target rotation speed, the feedback correction amount QFBI of the intake air quantity is sampled several times (for example, 25~32 times) for every predetermined sampling period (for example, 100 ms).

In step 22, the average value QFBIAVE of them is computed.

Next, in step 23, the learning value ISCLRC (new) is updated by weighting and averaging the learning value ISCLRC (old) of the previous intake air quantity and the average value QFBIAVE.

In step 24, the learning value ISCLRC of the intake air quantity is multiplied by a conversion coefficient CCONVA to compute the learning value ATASLN of the opening area of the throttle valve.

Figure 6:
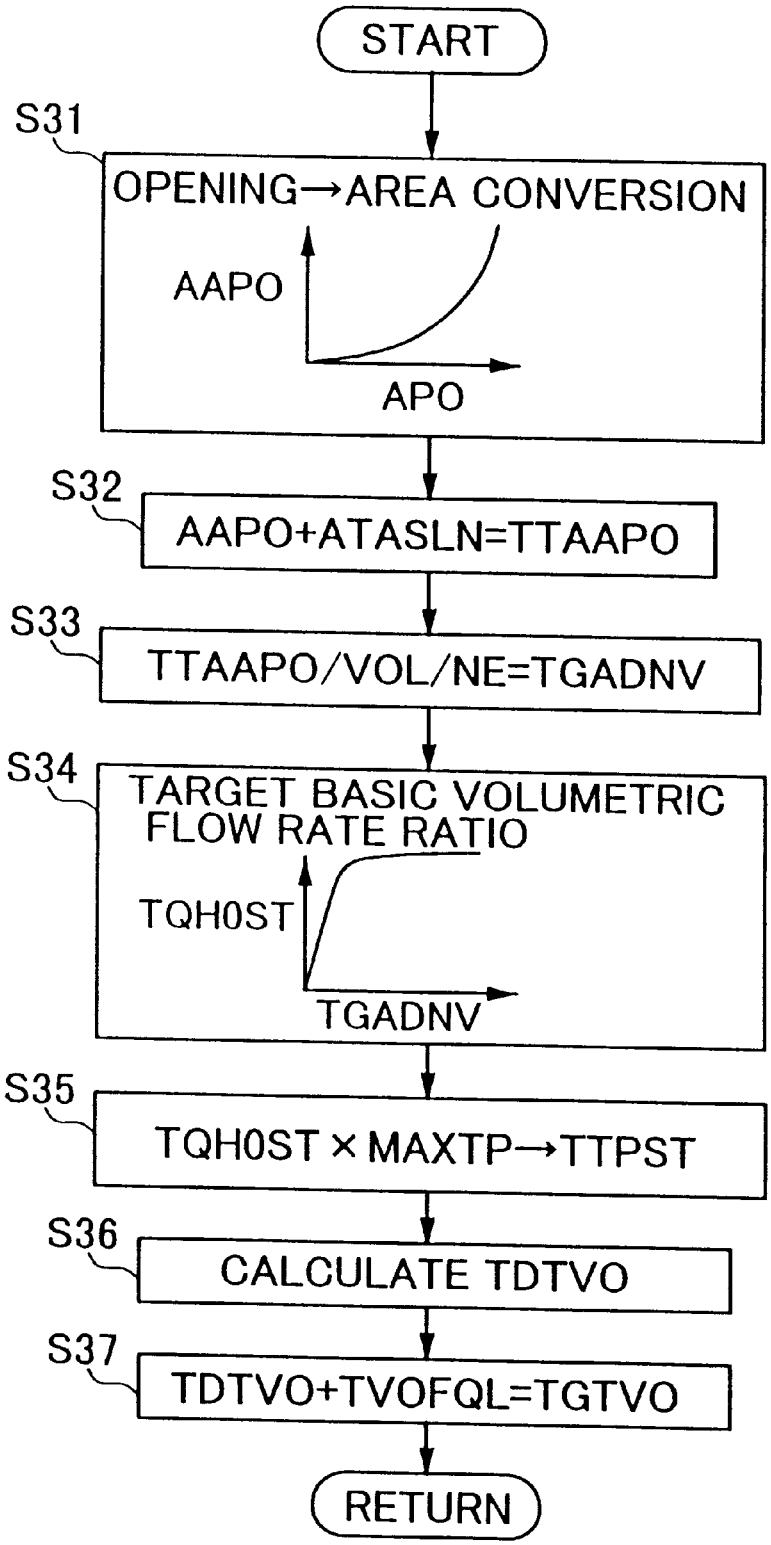
FIG. 6 is a flow chart showing a throttle valve opening control routine in the above embodiment.

Next, control of the throttle valve opening using the respective learning values of the air quantity learning and friction learning will be described in accordance with the flow chart in FIG. 6.

In step 31, the accelerator opening VAPO is converted into an accelerator opening area AAPO.

In step 32, a learning value ATASLN from the friction learning is added to the accelerator opening area MPO, to give an opening area TAAPO.

In step 33, the opening area TTAAPO is divided by the engine displacement VOL and the engine rotation speed NE, to calculate TGADNV corresponding to the opening area/induction volume.

In step 34, a target basic volumetric flow rate ratio TQHOST is calculated from the TGADNV.

In step 35, the target basic volumetric flow rate ratio TQHOST is multiplied by the maximum intake volume MAXTP for the engine rotational speed NE, to thereby calculate a target basic intake volume TTPST.

In step 36, a target new air quantity is calculated by considering the equivalence ratio, the EGR rate, the combustion efficiency and the like for the target basic intake volume TTPST, to thereby calculate a throttle valve opening TDTVO corresponding to the target new air quantity.

In step 37, an air quantity learning value TVOFLO is added to the throttle valve opening TDTVO corresponding to the new air quantity, to finally calculate a target throttle valve opening TGTVO.

As described above, for a change amount in the opening area with lapse of time due to soiling or blocking of the throttle valve, the target opening is learned and corrected with respect to variations in the friction and combustion efficiency, after the target opening is learned and corrected with respect to deviations of the detection value for the throttle valve opening from the actual opening. Therefore, the throttle valve opening can be controlled at a high accuracy with respect to the required engine output, while preventing erroneous learning.

What we claimed are:

1. An idle rotation speed learning control apparatus of an electronically controlled throttle type internal combustion engine, comprising:

target opening setting means for setting a target opening of a throttle valve according to a required output of an engine;

throttle valve drive means for opening and closing the throttle valve with an actuator so as to obtain said target opening;

air quantity learning means for learning and correcting the target opening of the throttle valve so as to obtain a target intake air quantity, by comparing an intake air quantity estimated based on a detection value of the throttle valve opening and an actually detected intake air quantity, at the time of idling the engine;

friction learning means for learning and correcting the target opening of the throttle valve so as to obtain a target engine output, while feedback controlling the throttle valve opening so that the engine rotation speed approaches a target idle rotation speed, at the time of idling the engine; and learning sequence means for performing learning by means of said friction learning means, after learning by means of said air quantity learning means is completed.

2. An idle rotation speed learning control apparatus of an electronically controlled throttle type internal combustion engine according to claim 1, wherein said air quantity learning means calculates a correction amount for a detection value of the throttle valve opening so that the intake air quantity estimated based on a detection value of the throttle valve opening and a detection value of the engine rotation speed becomes equal to the actually detected intake air quantity, and corrects the target opening of the throttle valve based on the correction amount.

3. An idle rotation speed learning control apparatus of an electronically controlled throttle type internal combustion engine according to claim 1, wherein the correction amount calculated by said air quantity learning means is limited by a limit value.

4. An idle rotation speed learning control apparatus of an electronically controlled throttle type internal combustion engine according to claim 1, wherein said air quantity learning means judges the time when more than a predetermined number of learning are performed as completion of the air quantity learning.

5. An idle rotation speed learning control apparatus of an electronically controlled throttle type internal combustion engine according to claim 1, wherein said friction learning means calculates the friction learning value based on an average value obtained by sampling the feedback correction quantity of the intake air quantity for a plurality of times for every predetermined sampling period.

6. An idle rotation speed learning control apparatus of an electronically controlled throttle type internal combustion engine according to claim 5, said friction learning means updates the learning value by average weighting the previous learning value and the average value of the intake air quantity.

7. An idle rotation speed learning control method of an electronically controlled throttle type internal combustion engine, comprising the steps of:

setting a target opening of a throttle valve according to a required output of an internal combustion engine, and opening and closing the throttle valve with an actuator so as to obtain the target opening;

performing air quantity learning for learning and correcting the target opening of the throttle valve so as to obtain a target intake air quantity, by estimating an intake air quantity based on a detection value of the throttle valve opening and comparing said estimated intake air quantity and an actually detected intake air quantity, at the time of idling the engine; and after completion of said air quantity learning, performing friction learning for learning and correcting the target opening of the throttle valve so as to obtain a target engine output, while feedback controlling the throttle valve opening so that the engine rotation speed approaches a target idle rotation speed, at the time of idling the engine.

8. An idle rotation speed learning control method of an electronically controlled throttle type internal combustion engine according to claim 7, wherein said step of performing air quantity learning calculates a correction amount for a detection value of the throttle valve opening so that the intake air quantity estimated based on the detection value of the throttle valve opening and a detection value of the engine rotation speed becomes equal to the actually detected intake air quantity, and corrects the target opening of the throttle valve based on the correction amount.

9. An idle rotation speed learning control method of an electronically controlled throttle type internal combustion engine according to claim 7, wherein the correction amount calculated by said step of performing air quantity learning is limited by a limit value.

10. An idle rotation speed learning control method of an electronically controlled throttle type internal combustion engine according to claim 7, wherein said step of performing air quantity learning judges the time when more than a predetermined number of learning are performed as completion of the air quantity learning.

11. An idle rotation speed learning control method of an electronically controlled throttle type internal combustion engine according to claim 7, wherein said step of performing friction learning calculates the friction learning value based on an average value obtained by sampling the feedback correction quantity of the intake air quantity for a plurality of times for every predetermined sampling period.

12. An idle rotation speed learning control method of an electronically controlled throttle type internal combustion engine according to claim 11, said step of performing friction learning updates the learning value by average weighting the previous learning value and the average value of the intake air quantity.

* * * * *